United States Patent [19]

Kutzner et al.

[11] 4,204,627

[45] May 27, 1980

[54] STAPLE CLOSING MECHANISM

[75] Inventors: Willi A. P. Kutzner; Georg Schneider, both of Wurzburg, Fed. Rep. of Germany

[73] Assignee: Koenig & Bauer Aktiengesellschaft, Wurzburg, Fed. Rep. of Germany

[21] Appl. No.: 966,449

[22] Filed: Dec. 4, 1978

[30] Foreign Application Priority Data

Dec. 10, 1977 [DE] Fed. Rep. of Germany ..... 2755210

[51] Int. Cl.[2] ..... B25C 5/04

[52] U.S. Cl. ..... 227/81; 227/87; 227/91; 227/155

[58] Field of Search ..... 227/81, 155, 87, 91, 227/92, 99, 110, 111

[56] References Cited

U.S. PATENT DOCUMENTS

| | | | |
|---|---|---|---|
| 2,207,413 | 7/1940 | Quick et al. | 227/87 |
| 2,709,808 | 6/1955 | Murrell et al. | 227/81 |
| 2,818,568 | 1/1958 | Turrall et al. | 227/81 |

FOREIGN PATENT DOCUMENTS

| | | | |
|---|---|---|---|
| 643014 | 9/1928 | France | 227/155 |
| 1160128 | 9/1959 | France | 227/155 |
| 1223840 | 3/1971 | United Kingdom | 227/81 |

*Primary Examiner*—John McQuade
*Attorney, Agent, or Firm*—Jones, Tullar & Cooper

[57] ABSTRACT

A staple closing mechanism for use in a longitudinal stapling apparatus for inserting and closing staples in a product conveyed at a uniform speed is disclosed. The staple closing mechanism includes a staple closing cylinder and a staple conveyor cylinder which cooperate to define a path through which the product is conveyed. The closing cylinder carries a rigid staple shank bending insert and a rotatable staple shank bending device. A staple driving die is carried by the staple conveyor cylinder.

14 Claims, 8 Drawing Figures

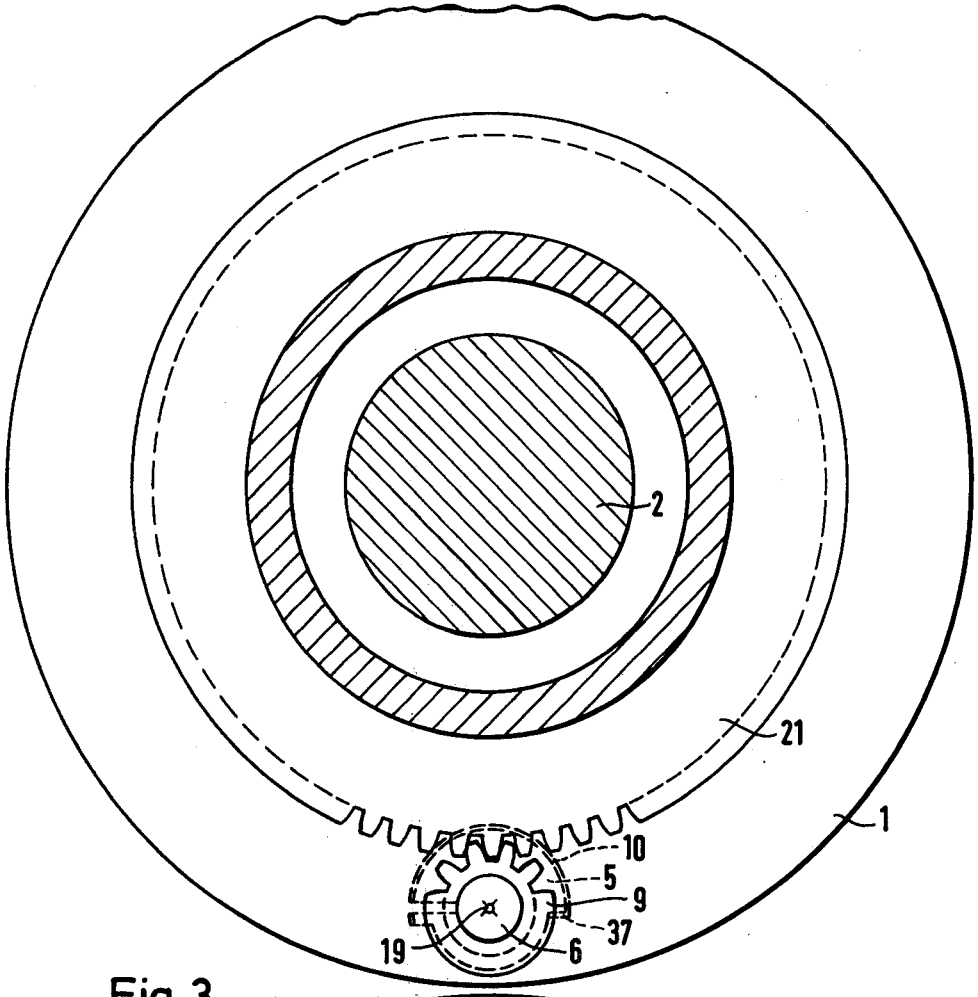
Fig.3
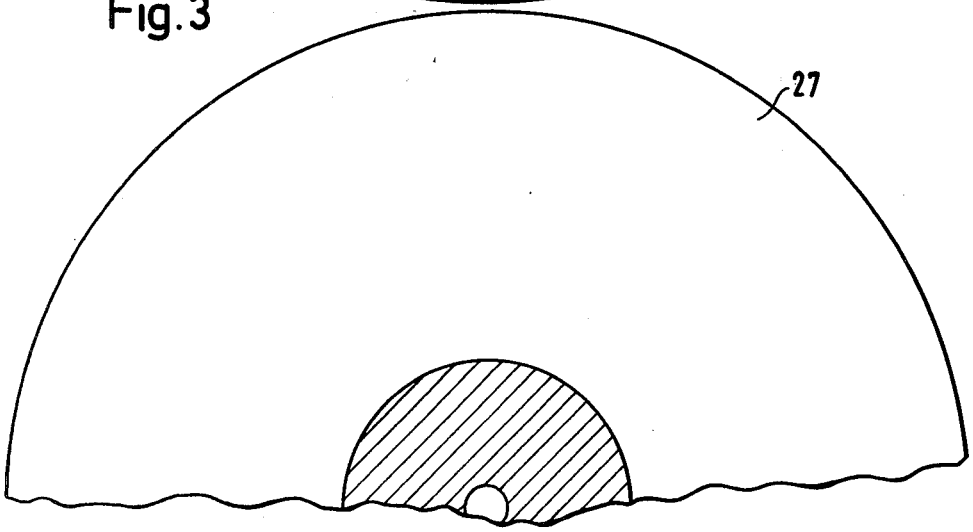

STAPLE CLOSING MECHANISM

FIELD OF THE INVENTION

The present invention is directed generally to staple closing assemblies. More particularly, the present invention is directed to a staple closing mechanism carried by two rotating drums or cylinders. Most specifically, the present invention is directed to a staple closing mechanism having a rigid staple shank bending insert and a cooperating rotary staple shank bending device which are both carried by one of the rotating drums.

A staple is driven into the product to be stapled as this product is passed between the rotating staple closing and conveying cylinders. The shanks of the staple pass through the product with one shank coming into contact with the fixed staple shank bending insert and with the second shank contacting the rotating shank bending device. The two shank bending elements cooperate to bend both shanks of the staple into engagement with the product. A slotted staple guiding tongue helps hold the staple as its shanks are bent over.

DESCRIPTION OF THE PRIOR ART

Longitudinal stapling devices are generally known in the art. These apparatuses are utilized to staple folded copies which are stopped during the stapling operation. Alternatively, the stapling head has, in the previously known devices, moved along with the product to be stapled during the stapling procedure. This type of stapling mechanism has been able to attain a stapling speed of up to only 12000 stapling operations an hour.

SUMMARY OF THE INVENTION

It is an object of the present invention to provide a staple closing mechanism for a high speed longitudinal stapling apparatus for stapling individual flat copies which are conveyed at a uniform speed.

Another object of the present invention is to provide a staple closing mechanism having a fixed shank bending insert and a rotatable shank bending device.

Yet a further object of the present invention is to provide a staple closing mechanism in which the shank bending means are carried by a rotating staple closing cylinder.

As will be set forth in greater detail in the description of a preferred embodiment, the staple closing mechanism in accordance with the present invention is comprised generally of a rotating staple closing cylinder and a spaced, cooperating rotating staple conveying cylinder. The closing cylinder carries a rigid staple shank bending insert and a rotatable shank bending device. The rigid insert bends a first shank of each staple and the rotatable bending device bends the second shank. The staple is forced through the product conveyed between the cylinders by a suitable staple driving die carried by the conveying cylinder. This staple closing mechanism is capable of operating at a much higher rate of speed than prior art devices and will perform very precise staple closings at stapling speeds in excess of 30,000 stapling operations per hour.

BRIEF DESCRIPTION OF THE DRAWINGS

While the novel features of the staple closing mechanism in accordance with the present invention are set forth with particularity in the appended claims, a full and complete understanding of the invention may be had by referring to the detailed description of a preferred embodiment as set forth hereinafter and as may be seen in the accompanying drawings in which:

FIG. 3 is a schematic side elevation view, partly in section, showing the driving mechanism for the staple closing mechanism;

DESCRIPTION OF A PREFERRED EMBODIMENT

Figure 1:
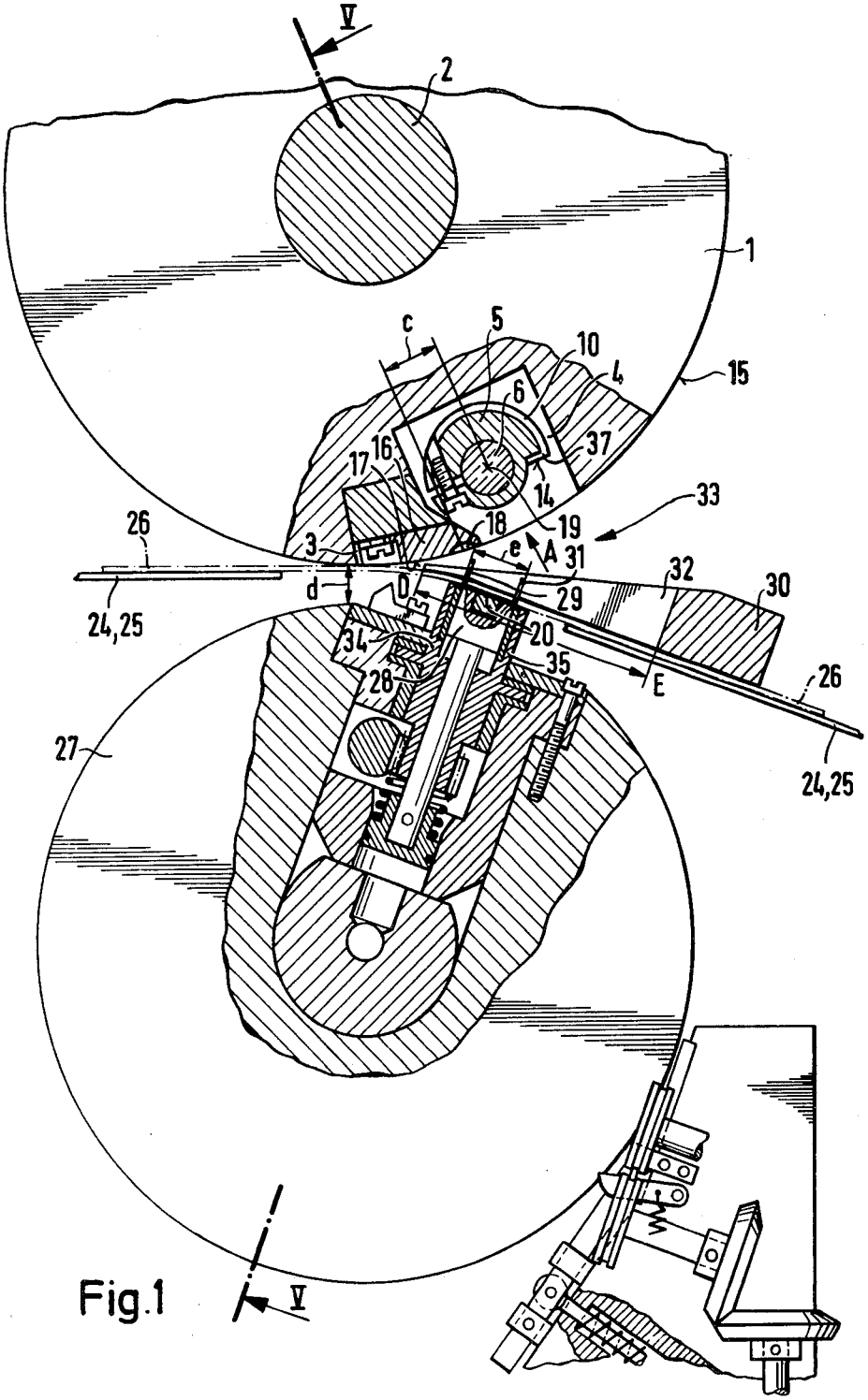
FIG. 1 is a side elevational view, partly in section, of a staple closing mechanism in accordance with the present invention with portions of the supporting frame removed for clarity.
Figure 5:
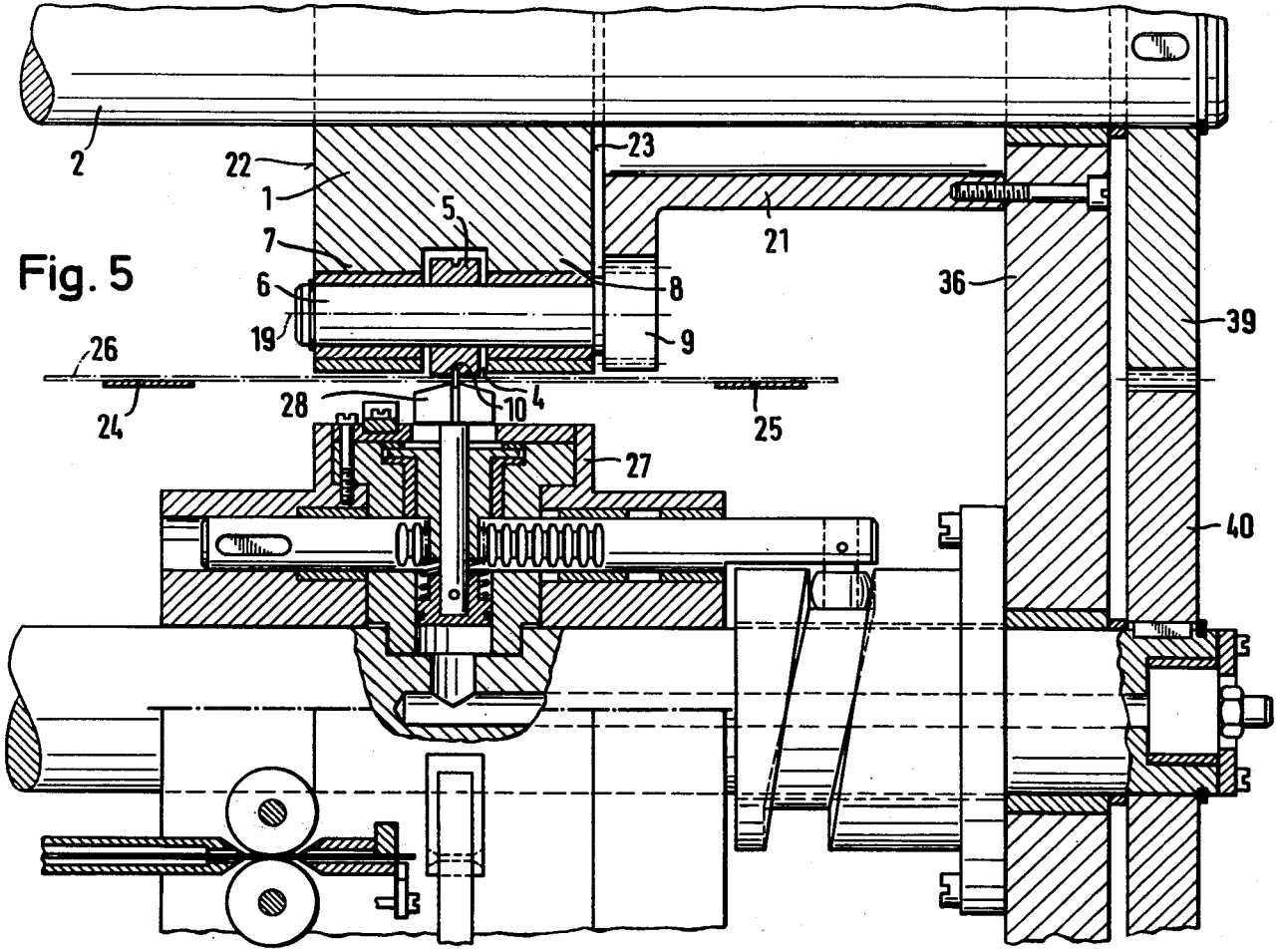
FIG. 5 is a partial cross-sectional view of the staple closing mechanism taken along line V—V of FIG. 1.

Turning now to FIG. 1, there may be seen a preferred embodiment of a staple closing mechanism in accordance with the present invention. A staple closing cylinder, generally indicated at 1, is rotatably carried by a shaft 2 which is supported in side frames 36, a portion of which are shown in FIG. 5. Staple closing cylinder 1 cooperates with a staple conveyor cylinder 27, as also seen in FIG. 1, with conveyor cylinder 27 also being mounted for rotation on a central shaft 112 supported by side frame 36, as may also be seen in FIG. 5. A product 26 to be stapled is fed between the two spaced cylinders and is supported during conveyance and stapling by a pair of spaced conveyor belts 24 and 25, as may be seen in FIGS. 1 and 2.

Figure 2:
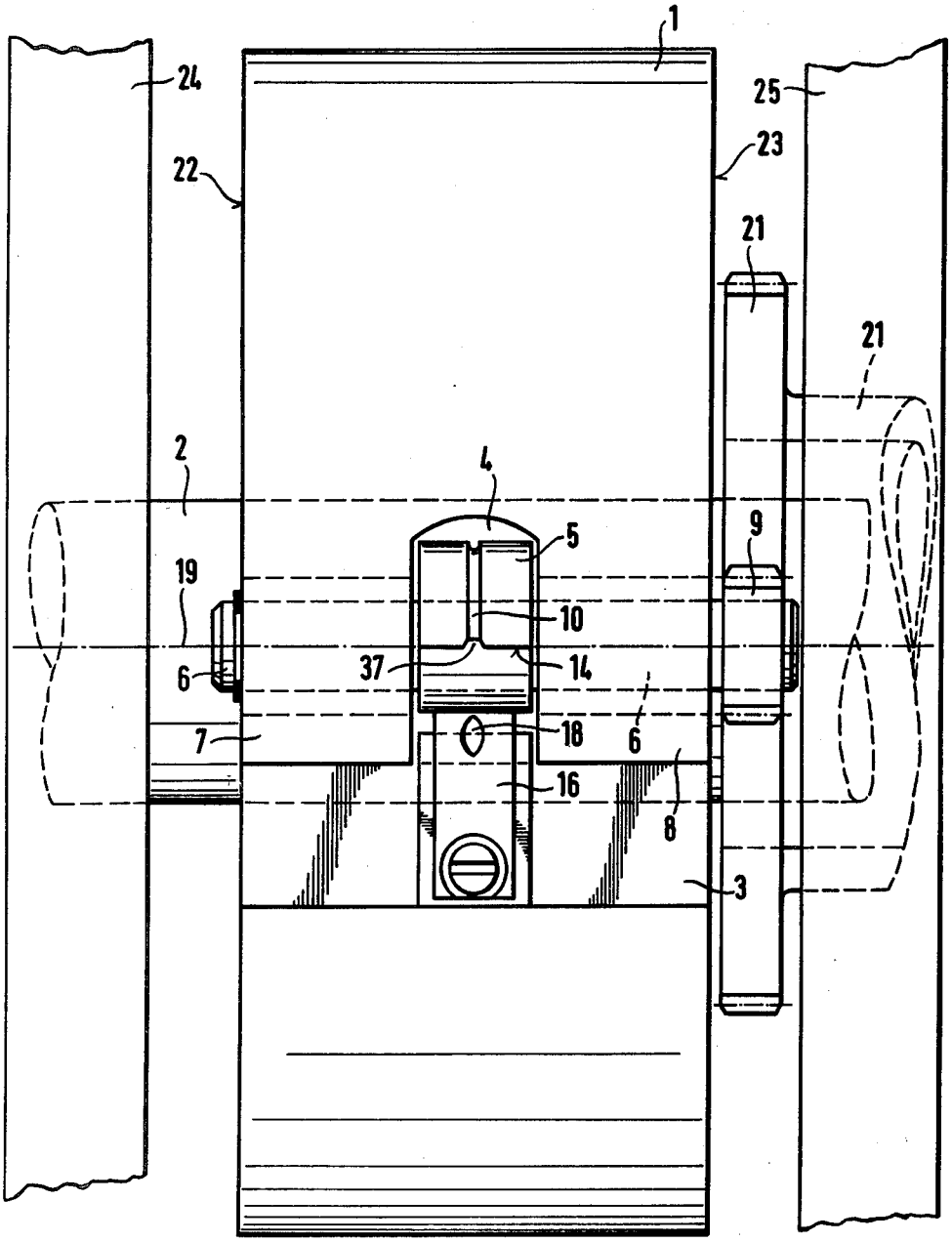
FIG. 2 is a bottom plan view of the upper cylinder of FIG. 1 taken in the direction indicated by arrow A in FIG. 1.

A gap 3 which extends in the direction of the longitudinal axis of the shaft 2 is milled into the periphery of the staple closing cylinder 1. A recess 4 is provided which extends in the peripheral direction of the staple closing cylinder 1 and is large enough to allow inside rotation of a staple shank bending device 5, as may be seen in FIGS. 1 and 2. The rotatable staple shank bending device 5 is secured on a shaft 6, which is supported in cross pieces 7 and 8 and which carries a gear pinion 9 upon its shaft end projecting from the staple closing cylinder 1, as shown in FIG. 2. The rotatable staple shank bending device 5 is generally disk shaped, and a groove 10 is milled into the center of its periphery, with the depth of the groove 10 corresponding approximately to the diameter of the staple wire used. The groove 10 continues as a generally triangular recess 37 in a shank bending surface 14 of the rotatable shank binding device 5 and serves to position the shank, which is to be crimped, in relation to groove 10.

Figure 4:
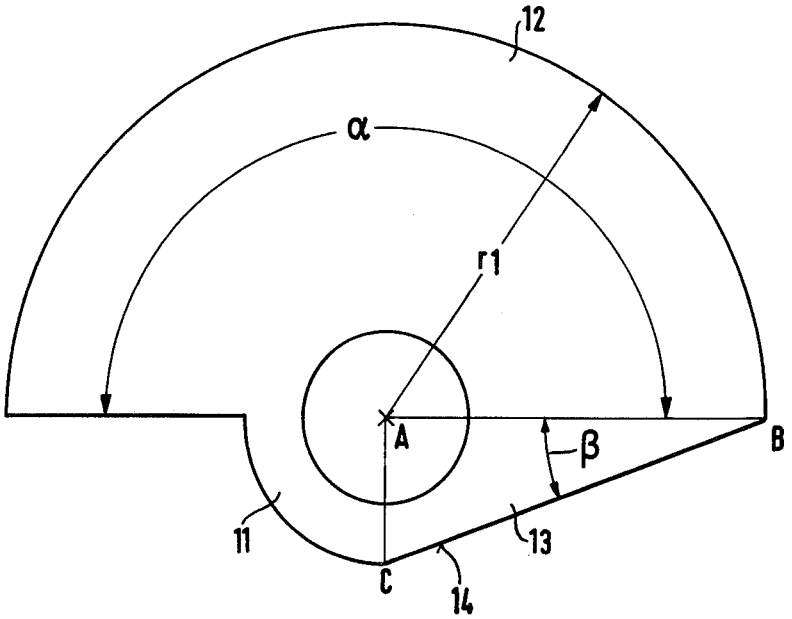
FIG. 4 is a schematic side elevation view of the rotatable staple shank bending device.

The cross sectional shape 11 of the staple shank bending device 5 is shown in FIG. 4 and comprises an arcuate sector 12 having a radius $r_1$, and a triangular surface 13 (ABC). The angle $\alpha$ of the sector 12 may be between 15° and 225°. The side B—C of triangle 13 (ABC) is inclined in relation to the side A—B of triangle 13 at an angle $\beta$ which may be between 1° and 20°. The side B—C corresponds to one side of the shank bending surface 14.

A rigid staple shank bending insert 16, which is in alignment with the rotatable staple shank bending device 5, is secured in the gap 3. An outer surface portion 17 of the rigid staple shank bending device 16 is of the same curvature as the curvature of a peripheral surface 15 of the staple closing cylinder 1 and carries a shank crimping form 18, or apple core approximately in its center. The center of the so-called apple core 18 and the axis of rotation 19 of the staple shank bending device 5 on shaft 6 are spaced a distance "c" which corresponds to the length "e" of the cross piece of a staple 20 to be closed, as may be seen in FIG. 1.

The rotatable staple shank bending device 5 is driven by means of gear pinion 9, the toothing of which meshes with the toothing of a gear 21 fixed to the side frame, as seen in FIG. 5.

Conveyor belts 24, 25 which move at the peripheral speed of the staple closing cylinder 1, are disposed to the right and left of lateral surfaces 22 and 23 of the staple shank closing cylinder 1, as may be seen most clearly in FIG. 5. The object of the belts 24 and 25 is to convey the products 26 to be stapled, through a slot "d" formed between the staple closing cylinder 1 and the staple conveyor cylinder 27. The staple conveyor cylinder 27 is equipped with a controllable staple driving die 28, such a staple driving die being disclosed in German Patent Application No. P 27 55 209.6 filed in Germany on Dec. 10, 1977, and corresponding to U.S. patent application Ser. No. 966,448, filed Dec. 4, 1978, and assigned to the assignee of the present application, which is capable of conveying the staples 20 in their longitudinal direction and crimping a first shank 29 of staple 20 in co-operation with the apple core 18. The staple conveyor cylinder 27 rotates at a speed equal to that of the staple closing cylinder 1 co-ordinated to it. A split staple guiding tongue 30 is secured to the frame and is positioned in the inlet wedge 33 formed by the staple closing cylinder 1 and the staple conveyor cylinder 27, the object of the guiding tongue 30 being to guide the shanks 29 and 31 of staple 20 after they have been forced through the product 26.

The shaft 112 which is supported in side frame 36 carries a driving gear 40 secured to end 113 of shaft 112. The wire stapling cylinder 27 is mounted on shaft 112, as may be seen in FIGS. 1 and 5. Gear 40 is driven by a main drive gear which is not shown in the drawings.

A cylindrical sleeve 110 is fitted into a shouldered boring 148 provided in the wire stapling cylinder 27, as seen in FIGS. 1 and 5, and is secured in place. The cylindrical inserted sleeve 110 serves to support a rotatable bushing 111, in which a driving rod 212 and a piston 213, which is secured to the driving rod 212, are supported and are capable of being displaced radially. The rotatable bushing 111 carries, at its upper end, a pair of cross pieces 34 and 35, which serve to guide a staple driving punch 28 which inserts a staple 20. The driving punch 28 has a circular cross-section, from which two guiding surfaces, which extend parallel to each other, have been cut off. Due to this shape of its cross section, the driving punch 28 cannot turn within the space between the cross pieces 34 and 35, and must follow the rotational motion of the rotatable bushing 111. The rotatable bushing 111 and the driving punch 28 are capable of rotating around a straight line "g" passing through the center 118 of the wire stapling cylinder 27.

Parallel to the axis of rotation 118 of the shaft 112, a through boring 119 is provided in the wire stapling cylinder 27, as shown in FIG. 5. The boring 119 serves to support a half-round rack 120 which can be displaced in a reciprocating motion and which is provided with gear teeth 121. The teeth 121 mesh with teeth of a rim gear 122 portion of the rotatable bushing 111. The rack 120 carries a journal 123 with a control roller 124 on its free extremity. The control roller 124 rotates in a switching groove portion 125 of a hollow cylinder 127 disposed concentrically about the shaft 112 and secured to the side frame 36 by means of a flange 128, as seen in FIG. 5. The switching groove 125 is dimensioned in a way such that the rack 120 makes one to-and-fro motion per rotation of the wire stapling cylinder 27, thus turning the rotatable bushing 111 through 90° around the straight line "g" with every rotation of cylinder 27. This rotational motion is also followed by the driving punch 28.

A radial boring 129 in sleeve 110, in which the piston 213 may reciprocally be moved, ends in a pocket boring 126 extending along the axis of rotation 118 of the shaft 112. This pocket boring 126 communicates with a driving means such as, for example, compressed air, which is infed under suitable control. A compression spring 130 is fixed between a front surface 150 of the rotatable bushing 111 and the piston 213. The object of the compression spring 130 is to drive the piston 213 back into the boring 129 if the normal driving means fails.

Stapling wire 133 is fed from a supply coil of wire, not shown, which is disposed outside the wire stapling cylinder 27, by means of conveyor rollers 131 and 132 into a conventional wire cutting device 134, which is operated by means of a switching cam 135 carried on the wire stapling cylinder 27. A forming piece 137 is mounted on a support 136 fixed to the frame 36, the forming piece 137 being disposed in manner such as to be located, during rotation of the wire stapling cylinder 27, between the cross pieces 34 and 35 of the rotatable bushing 111. The stapling wire 133 is cut by cutting device 134 and is pressed between the cross pieces 34 and 35 by the obliquely positioned forming piece 137 into the driving punch 28, thus being formed into a staple 20. Staple 20 is retained between hard metal plate portions 141 and 143 of the cross pieces 34 and 35 of the rotatable bushing by a permanent magnet 159 inserted into the top surface of the driving punch 28.

Figure 6:
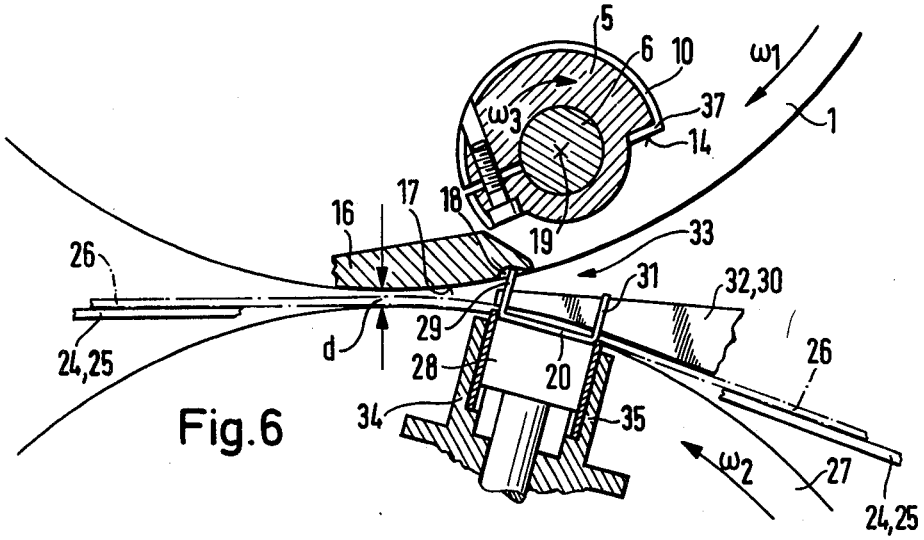
FIGS. 6, 7 and 8 are schematic side elevation views showing a staple closing operation.
Figure 7:
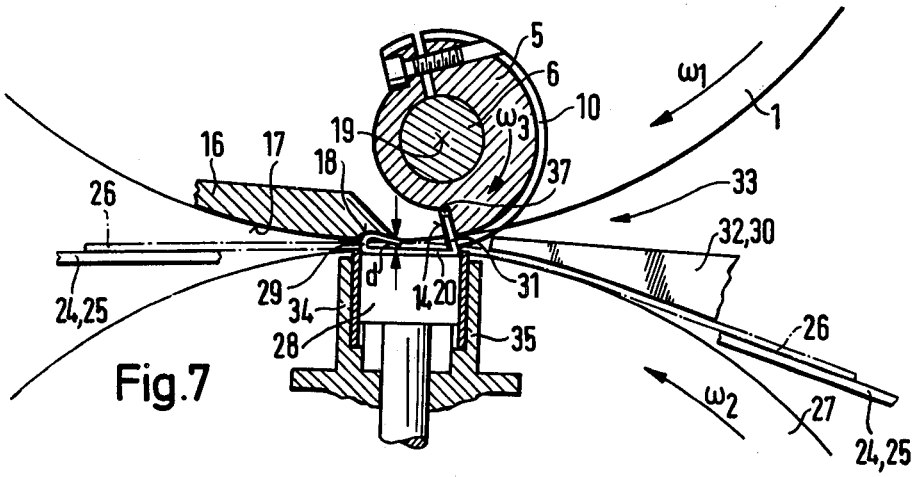
Figure 8:
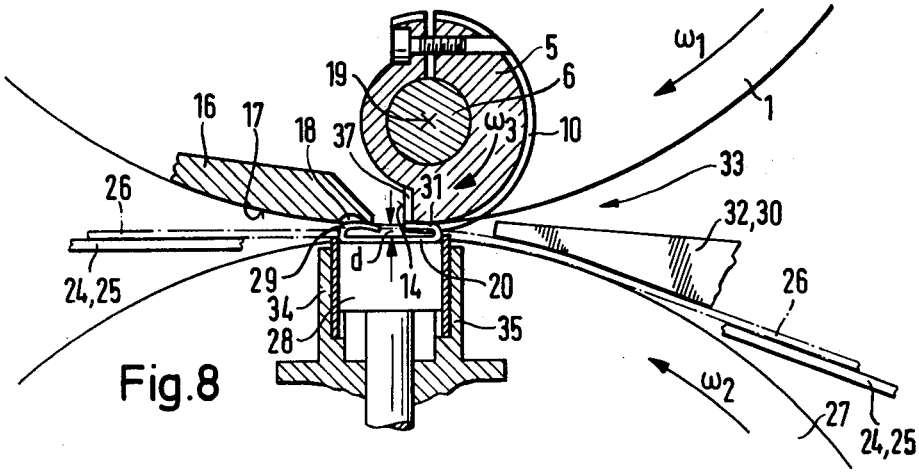

In operation, a staple 20 is positioned on the staple driving die 28 with shanks 29, 31 extending upwards as die 28 moves, together with the staple conveyor cylinder 27, in the direction of rotation of the staple conveyor cylinder 27, as may be seen in FIGS. 6–8. The staple closing cylinder 1 is driven by means of the gears 39, 40. Gear 39 is secured on shaft 2 and gear 40 is connected to the main drive of the device. The staple 20 initially rests inside cross pieces 34 and 35 of cylinder 27 so that the points of shanks 29, 31 do not project above the periphery of the staple conveyor cylinder 27. As soon as the staple driving die 28 enters the area DE of the split 32 of the guiding tongue 30, as shown in FIG. 1, the staple driving die 28 is activated to force the shanks 29, 31 of staple 20 completely through the product 26. During this operation, the shanks 29, 31 of the staple 20 enter the slit 32 of the guiding tongue 30. The slit 32 then takes over the guidance of the shanks 29, 31, that is to say, the shanks are prevented from laterally tilting during insertion. During its movement on the staple conveyor cylinder 27, the point of the shank 29 of the staple 20 enters into the apple core 18, as is shown in FIG. 6. During the further course of rotary motion of cylinders 1 and 27, the inlet wedge 33 formed by the staple conveyor cylinder 27 and the staple closing cylinder 1, becomes narrower, and the first shank 29 is bent in a known manner opposite to the direction of rotation of the staple conveyor cylinder 27. With further rotational motion of the staple conveyor cylinder 27 and the staple closing cylinder 1, and due to the rotational motion of the staple shank bending device 5, the bending surface 14 of staple shank bending device 5 is positioned behind the shank 31. Finally the shank bending surface 14 engages the shank 31, and by means of further rotational motion of the staple shank bending device 5, the bending surface 14 and the groove 10 bend the shank 31 in the direction of rotation of the staple conveyor cylinder 27, as is shown in FIG. 7, until the staple 20 is closed, as is shown in FIG. 8. The angular speed $\omega_3$ of the staple shank bending device 5 is greater than the angular speed $\omega_2$ of the staple conveyor cylinder 27, and is preferably between three and eight times greater. The gear ratio between the gear 21 and the gear pinion 9 is dimensioned accordingly. The angular speed $\omega_1$ of the staple closing cylinder 1 is equal to the angular speed of the staple conveyor cylinder 27. The groove 10, extending around the staple shank bending device 5, guides the shank 31 during the bending operation. After a staple closing cycle is completed, the mechanism repeats the same sequence of steps for each staple closing cycle.

It will thus be seen that there has hereinabove been fully and completely disclosed a preferred embodiment of a staple closing mechanism in accordance with the present invention. It will be obvious to one of ordinary skill in the art that a number of changes in for example, the type of drive gearing used, the operation of the staple driving die, the speed of rotation of the drums, and the like could be made without departing from the true spirit and scope of the invention and that the invention is to be limited only by the following claims.

We claim:

1. A staple closing mechanism for use in a longitudinal stapling apparatus for stapling products which are conveyed at a uniform speed, in which a rigid staple shank bending insert and a rotatable staple shank bending device are positioned on a continuously rotatable staple shank closing cylinder, and in which the rigid staple shank bending insert is disposed to act upon a first staple shank, and the rotatable staple shank bending device is disposed to act upon a second shaft of a staple to be closed to close said staple.

2. A mechanism according to claim 1, in which the distance between the center of a shank crimping form of said rigid staple shank bending insert and the axis of rotation of the rotatable staple shank bending device is approximately equal to the length of a cross piece of the staple to be closed.

3. A mechanism according to claim 1 or 2, in which a center angle of a sector of said rotatable staple shank bending device is an angle between 15° and 225°.

4. A mechanism according to claim 1 or 2 in which a shank bending surface of said rotatable bending device is inclined at an angle between 1° and 20°.

5. A mechanism according to claim 1, in which the periphery of said rotatable staple shank bending device is equipped with a groove for guiding the staple during closing.

6. A mechanism according to claim 1, in which a staple guiding tongue equipped with a slit is disposed in an inlet wedge formed by the staple shank closing cylinder and a spaced cooperating staple conveyor cylinder.

7. A mechanism according to claim 1, in which the angular speed of rotation of the staple shank bending device is between three and eight times the angular speed of rotation of the staple shank closing cylinder, and in which the angular speeds of rotation of the staple shank closing cylinder and a spaced, cooperating staple conveyor cylinder are equal.

8. A staple closing mechanism for inserting a staple through a product and for closing first and second shanks of said staple about the product, said staple closing mechanism comprising:

a rotatable staple closing cylinder and a spaced, cooperating rotatable staple conveying cylinder, the product passing between said spaced cylinders during insertion and closing of said staple;

means on said conveying cylinder for driving said staple through said product;

a rigid staple shank bending insert on said closing cylinder, said insert adapted to contact said first shank of said staple to bend said first shank to a closed position;

a rotatable staple shank closing device rotatably carried on said closing cylinder, said rotatable closing device adapted to contact said second shank of said staple to close said second shank; and means to rotate said closing and conveying cylinders at a first rotational speed and to rotate said rotatable staple shank closing device at a second rotational speed three to eight times faster than said first rotational speed.

9. A staple closing mechanism according to claim 8 wherein a staple guiding tongue having a split portion is positioned in an inlet wedge formed by said rotatable cylinders.

10. The staple closing mechanism of claim 9 wherein said staple to be closed is positioned in said split portion of said staple guiding tongue by said staple driving means, said staple guiding tongue holding said staple during bending of said shanks.

11. The staple closing mechanism of claim 8 wherein said rotatable staple shank closing device is generally disc shaped and includes a staple bending surface.

12. The staple closing mechanism of claim 11 wherein said rotatable staple shank closing device has a groove extending along its periphery.

13. The staple closing mechanism of claim 8 wherein said rigid staple shank bending insert has a curved outer periphery corresponding to the curved periphery of said staple closing cylinder.

14. The staple closing mechanism of claim 13 wherein said staple shank bending insert includes a shank crimping form.

* * * * *